US005921761A

United States Patent [19]

Eckels

[11] Patent Number: 5,921,761

[45] Date of Patent: Jul. 13, 1999

[54] SCROLL MACHINE WITH DISCHARGE DUCT

[75] Inventor: Richard Edgar Eckels, Spring Valley, Ohio

[73] Assignee: Copeland Corporation, Sidney, Ohio

[21] Appl. No.: 08/840,864

[22] Filed: Apr. 17, 1997

[51] Int. Cl.[6] ..... F01C 1/04; F01C 21/06

[52] U.S. Cl. ..... 418/55.1; 418/86

[58] Field of Search ..... 418/55.1, 86

[56] References Cited

U.S. PATENT DOCUMENTS

| | | | |
|---|---|---|---|
| 4,431,388 | 2/1984 | Eber et al. | 418/55.1 |
| 5,247,736 | 9/1993 | Fraser, Jr. et al. | 418/55.1 |
| 5,346,375 | 9/1994 | Akiyama et al. | 418/55.1 |

FOREIGN PATENT DOCUMENTS

| | | | |
|---|---|---|---|
| 63-268992 | 11/1988 | Japan | 418/55.1 |
| 1130082 | 5/1989 | Japan | 418/55.1 |
| 2196182 | 8/1990 | Japan | 418/55.1 |
| 3107594 | 5/1991 | Japan | 418/55.1 |
| 5-79477 | 3/1993 | Japan | 418/55.1 |
| 6-58281 | 3/1994 | Japan | 418/55.1 |
| 6241178 | 8/1994 | Japan | 418/55.1 |
| 6307356 | 11/1994 | Japan | 418/55.1 |

*Primary Examiner*—John J. Vrablik

*Attorney, Agent, or Firm*—Harness, Dickey & Pierce, P.L.C.

[57] ABSTRACT

A scroll compressor includes a duct which is located within the discharge chamber of the compressor. The duct receives compressed fluid from the discharge port of the scrolls and directs the flow of the compressed fluid directly to the fluid port extending through the shell. The control of the discharge fluid directly from the discharge port of the scrolls provides a quieter and cooler operating compressor.

20 Claims, 3 Drawing Sheets

SCROLL MACHINE WITH DISCHARGE DUCT

FIELD OF THE INVENTION

The present invention relates generally to scroll type machines. More particularly, the present invention relates to a scroll type compressor incorporating a discharge duct located within the discharge or muffler chamber of the compressor.

BACKGROUND AND SUMMARY OF THE INVENTION

Scroll machines in general and particularly scroll compressors are generally provided with a hermetic shell which defines a chamber within which is disposed a working fluid. A partition within the shell divides the chamber into a discharge pressure zone and a suction pressure zone. A scroll assembly is located within the suction pressure zone for compressing the working fluid. Generally, these scroll assemblies incorporate a pair of intermeshed spiral wraps, one of which is caused to orbit relative to the other so as to define one or more moving chambers which progressively decrease in size as they travel from an outer suction port towards a center discharge port. An electric motor is normally provided which operates to drive the orbiting scroll wrap via a suitable drive shaft.

The partition within the shell must allow compressed fluid exiting the center discharge port of the scroll assembly to enter the discharge pressure zone within the shell while simultaneously maintaining the integrity between the discharge pressure zone and the suction pressure zone. This function of the partition is normally accomplished by a seal which interacts with the partition and with the scroll member defining the center discharge port.

The discharge pressure zone of the hermetic shell can also function as a muffler chamber and is normally provided with a discharge fluid port which communicates with a refrigeration circuit or some other type of fluid circuit. The opposite end of the fluid circuit is connected with the suction pressure zone of the hermetic shell using a suction fluid port extending through the shell into the suction pressure zone. Thus the scroll machine receives the working fluid from the suction pressure zone of the hermetic shell, compresses this working fluid in the one or more moving chambers defined by the scroll assembly and discharges the compressed working fluid into the discharge pressure zone of the compressor. The compressed working fluid is directed through the discharge fluid port to the fluid circuit and returns to the suction pressure zone of the hermetic shell through the suction port.

In certain compressors, the center discharge port is positioned so that relatively hot compressed gas is discharged toward a local area on the interior surface of the hermetic shell in which the compressor is disposed. The compressed discharge gas is normally relatively hot. However, under certain conditions, such as a loss of charge, system blocked fan operation, or transient operation at a high compression ratio, the discharge gas may become exceedingly hot. When this hot compressed gas impinges on the interior of the shell, an undesirable localized hot spot is formed. This localized hot spot can present a hazardous situation as well as reducing the strength and durability of the shell material.

Further, when compressed gas impinges on the interior surface of the shell, noise and vibration are transmitted directly to the shell. When the scroll machine is used as a compressor in refrigeration, air conditioning and heat pump applications, it is particularly advantageous to maintain the lowest operational noise level as possible. Accordingly, the continued development of scroll machines and their fluid systems has been directed to reducing both the operational noise levels of the machines as well as eliminating the problems associated with the discharge of the relatively hot discharge gases.

The present invention provides the art with a discharge duct which directs the relatively hot discharge gases from the center discharge port of the scrolls to the discharge port of the discharge pressure zone of the compressor. The discharge duct significantly reduces any localized hot spots on the compressor shell.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
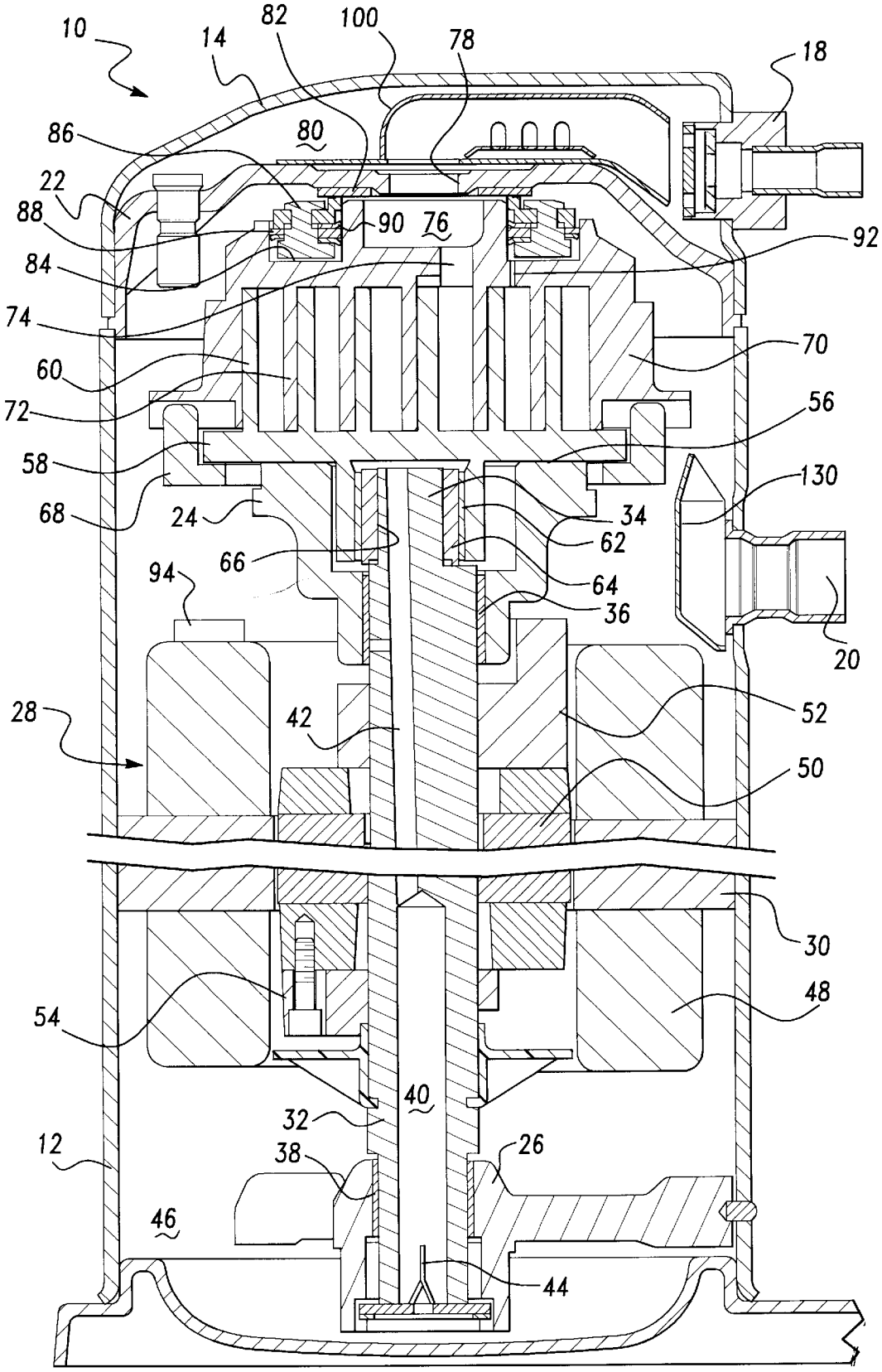
FIG. 1 is a vertical sectional view of a scroll compressor incorporating a discharge duct in accordance with the present invention.
Figure 2:
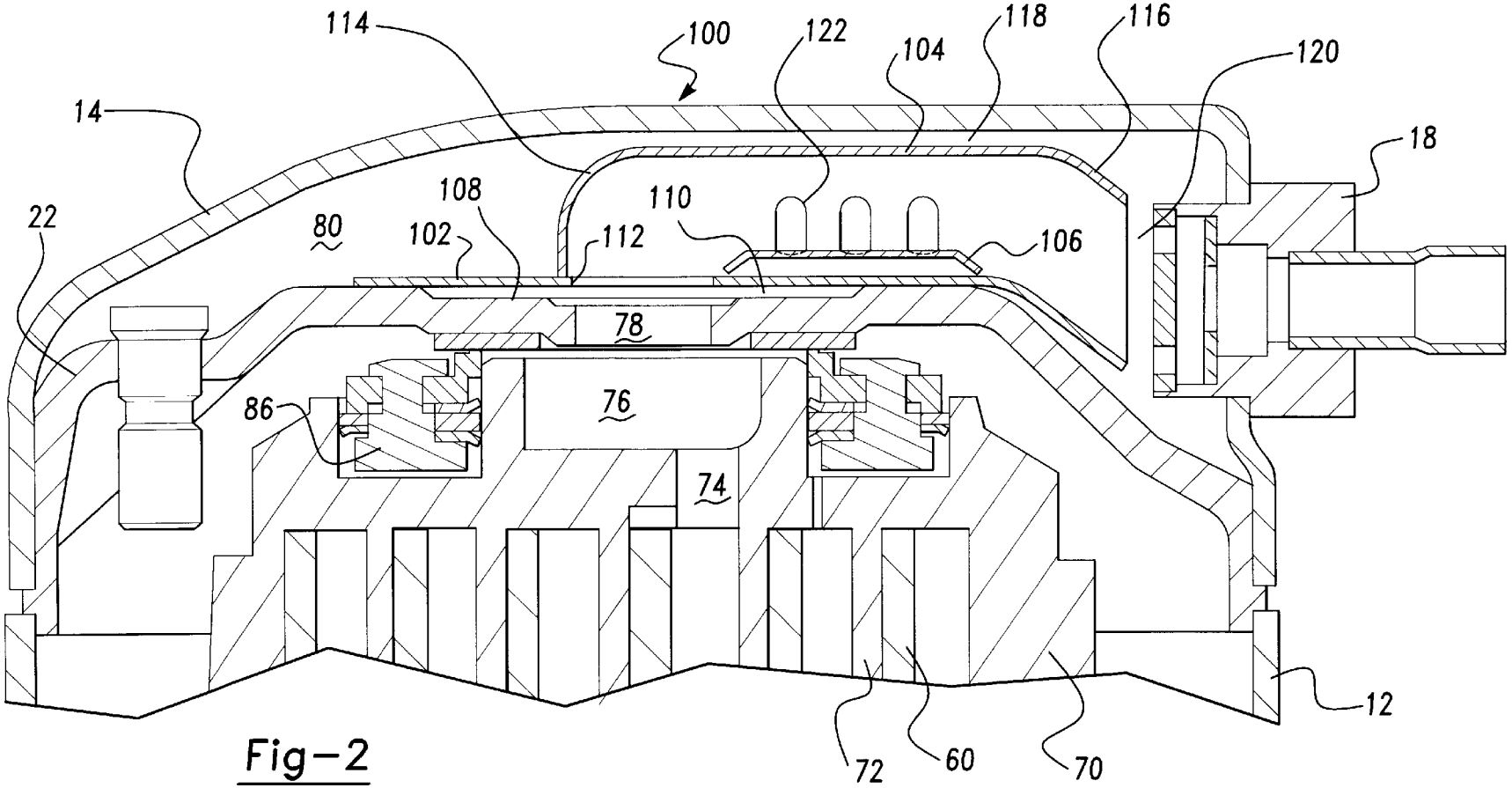
FIG. 2 is an enlarged vertical sectional view of the discharge pressure zone of the compressor shown in FIG. 1.
Figure 3:
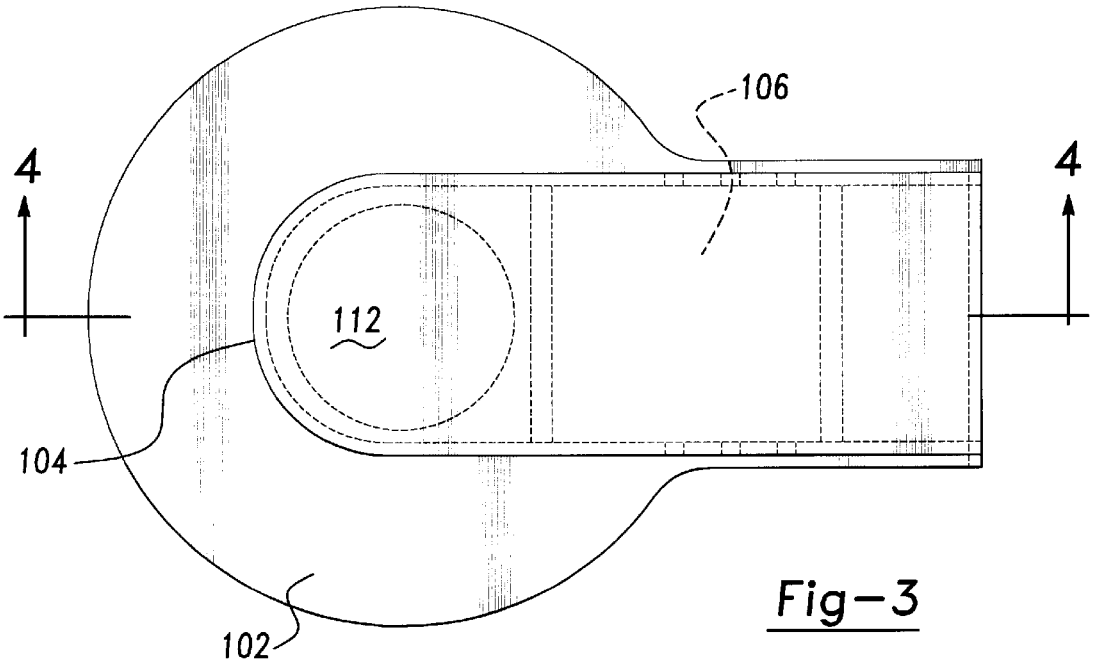
FIG. 3 is a top plan view of the discharge duct shown in FIGS. 1 and 2.
Figure 4:
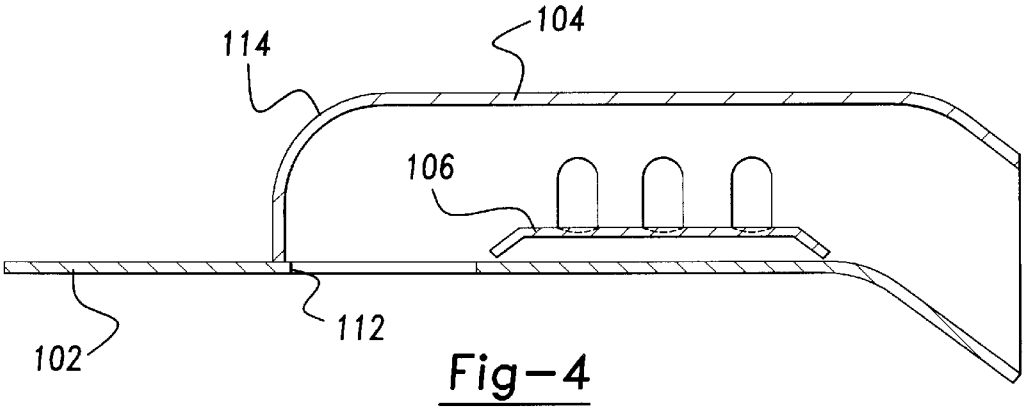
FIG. 4 is a vertical sectional view of the discharge duct taken in the direction of arrows 4—4 shown in FIGS. 3.
Figure 5:
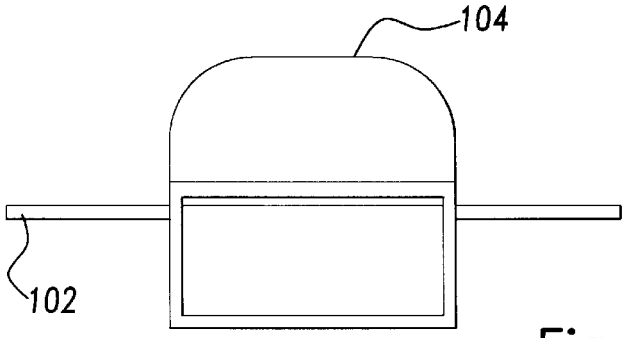
FIG. 5 is a side elevational view of the discharge duct shown in FIGS. 1–3.

While the present invention is suitable for incorporation in many different types of scroll machines, for exemplary purposes it will be described herein incorporated in a scroll refrigerant compressor of the general structure illustrated in FIG. 1. Referring now the drawings and in particular to FIG. 1, a compressor 10 is shown which comprises a generally cylindrical hermetic shell 12 having welded at the upper end thereof a cap 14. Cap 14 is provided with a refrigerant discharge fitting 18 which may have the usual discharge valve therein. Other major elements affixed to shell 12 include an inlet fitting 20, a transversely extending partition 22 which is welded about its periphery at the same point that cap 14 is welded to shell 12, a main bearing housing 24 and a lower bearing housing 26 each having a plurality of radially outwardly extending legs each of which is suitably secured to shell 12. A drive shaft or crankshaft 32 having an eccentric crank pin 34 at the upper end thereof is rotatably journalled in a bearing 36 in main bearing housing 24 and a second bearing 38 in lower bearing housing 26. Crankshaft 32 has at the lower end a relatively large diameter concentric bore 40 which communicates with a radially outwardly inclined smaller diameter bore 42 extending upwardly therefrom to the top of crankshaft 32. Disposed within bore 40 is a stirrer 44. The lower portion of the interior shell 12 defines an oil sump 46 which is filled with lubricating oil. Bore 40 acts as a pump to pump lubricating fluid up the crankshaft 32 and into bore 42 and ultimately to all of the various portions of the compressor which require lubrication.

Crankshaft 32 is rotatively driven by an electric motor 28 including a motor stator 30, windings 48 passing therethrough and a motor rotor 50 press fitted on crankshaft 32 and having upper and lower counterweights 52 and 54, respectively.

The upper surface of main bearing housing 24 is provided with a flat thrust bearing surface 56 on which is disposed an orbiting scroll member 58 having the usual spiral vane or wrap 60 on the upper surface thereof. Projecting downwardly from the lower surface of orbiting scroll member 58 is a cylindrical hub having a journal bearing 62 therein and in which is rotatively disposed a drive bushing 64 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 58 and bearing housing 24. Oldham coupling 68 is keyed to orbiting scroll member 58 and a non-orbiting scroll member 70 to prevent rotational movement of orbiting scroll member 58. Oldham coupling 68 is preferably of the type disclosed in assignee's U.S. Pat. No. 5,320,506, the disclosure of which is hereby incorporated herein by reference.

Non-orbiting scroll member 70 is also provided having a wrap 72 positioned in meshing engagement with wrap 60 of orbiting scroll member 58. Non-orbiting scroll member 70 has a centrally disposed discharge passage 74 which communicates with an upwardly open recess 76 which in turn is in fluid communication via an opening 78 in partition 22 with a discharge muffler chamber 80 defined by cap 14 and partition 22. The entrance to opening 78 has an annular seat portion 82 therearound. Non-orbiting scroll member 70 has in the upper surface thereof an annular recess 84 having parallel coaxial sidewalls in which is sealingly disposed for relative axial movement an annular floating seal 86 which serves to isolate the bottom of recess 84 from the presence of gas under suction pressure at 88 and discharge pressure at 90 so that it can be placed in fluid communication with a source of intermediate fluid pressure by means of a passageway 92. Non-orbiting scroll member 70 is thus axially biased against orbiting scroll member 58 to enhance wrap tip sealing by the forces created by discharge pressure acting on the central portion of scroll member 70 and those created by intermediate fluid pressure acting on the bottom of recess 84. Discharge gas in recess 76 and opening 78 is also sealed from gas at suction pressure in the shell by means of seal 86 acting against seat portion 82. This axial pressure biasing and the functioning of floating seal 86 are disclosed in greater detail in assignee's U.S. Pat. No. 5,156,539, the disclosure of which is hereby incorporated herein by reference. Non-orbiting scroll member 70 is designed to be mounted to bearing housing 24 in a suitable manner which will provide limited axial (and no rotational) movement of non-orbiting scroll member 70. Non-orbiting scroll member 70 may be mounted in the manner disclosed in the aforementioned U.S. Pat. No. 4,877,382 or U.S. Pat. No. 5,102,316, the disclosure of which is hereby incorporated herein by reference.

The compressor is preferably of the "low side" type in which suction gas entering via fitting 20 is allowed, in part, to escape into the shell and assist in cooling the motor. So long as there is an adequate flow of returning suction gas the motor will remain within desired temperature limits. When this flow ceases, however, the loss of cooling will cause a motor protector 94 to trip and shut the machine down.

The scroll compressor as thus far broadly described is either now known in the art or is the subject of other pending applications for patent or patents of applicant's assignee.

The present invention is directed toward a unique discharge duct assembly 100 which is fixedly secured to partition 22 in line with the flow of compressed refrigerant exiting discharge passage 74 and entering discharge chamber 80 through recess 76 and opening 78.

Referring now to FIGS. 2–5, discharge duct assembly 100 comprises, a mounting flange 102, a duct 104 and a ramp 106. Flange 102 is fixedly secured to partition 22 near the outer periphery of flange 102. Partition 22 has an annular recessed area 108 which with flange 102 forms an annular gap 110. Annular gap 110 reduces the heat transfer between partition 22 and flange 102. Flange 102 defines a generally circular opening 112 which is aligned with opening 78 to allow the flow of compressed fluid from discharge passage 74 and into duct assembly 100. Duct 104 is fixedly secured to flange 102 and functions to direct the flow of discharge fluid from opening 112 towards discharge fitting 18 which then leads to the fluid circuit. Fluid entering duct 104 impinges on a large radiused end 114 of duct 104 and is turned 90° to be directed towards discharge fitting 18. The exit end 116 of duct 104 is angled to align with discharge fitting 18. A gap 118 is maintained between duct 104 and cover 14 to prevent heat transfer between the two components. A gap 120 is maintained between duct 104 and discharge fitting 18 in order to relieve pulsation of the compressor fluid. A plurality of apertures 122 extend through the wall of duct 104 in order to equalize the fluid pressure between the inside of duct 104 and discharge chamber 80.

Ramp 106 is disposed within duct 104 and is fixedly secured to the bottom wall of duct 104. Ramp 106 serves to smooth the flow of refrigerant through duct 104 and into discharge fitting 18.

Suction or return gas on entering shell 12 through inlet fitting 20 immediately impinges on a suction baffle 130, shown in FIG. 1, which is attached to inlet fitting 20 and the majority of this fluid is directed upward to the area between non-orbiting scroll member 70 and partition 22. This suction gas cools non-orbiting scroll member 70 and effectively reduces the polytropic compression coefficient. The suction gas continues over non-orbiting scroll member 70 and downward within shell 12 to cool motor 28. On compressors which do not incorporate duct assembly 100, partition 22 is heated by the warmer discharge gas in discharge chamber 80 and this heat is transferred to the suction gas as it passes between non-orbiting scroll member 70 and partition 22.

The basic principle of duct assembly 100 is to isolate partition 22 from heat as much as possible. This is accomplished by ensuring that the discharge gas does not circulate within discharge chamber 80. Duct assembly 100 creates a stagnant gas volume around duct assembly 100 within discharge chamber 80 and this stagnant gas volume acts as an insulating layer. Since the convective heat transfer coefficient is a function of gas velocity, the lower the velocity, the lower the convective heat transfer coefficient will be.

The substantial isolation of partition 22 from the hot discharge gases caused by duct assembly 100 significantly reduces the temperature of partition 22 during compressor operation. The suction gas which circulates between non-orbiting scroll member 70 and partition 22 will receive less heat from partition 22 and will thus be at a lower temperature than a comparable compressor without duct assembly 100. The cooler gas reaching motor 28 then lowers the motor temperature compared to a comparable compressor assembly without duct assembly 100 resulting in reduced power consumption. The suction gas then continues on to the scroll inlet at a lower temperature increasing gas density, and consequently mass flow. All of these processes benefit from the reduction in heat gained by the suction gas as it passes over partition 22.

An additional benefit of duct assembly 100 is the significant reduction in the temperature of cap 14. Duct assembly 100 eliminates the impingement of hot discharge gases on the inner surface of cap 14 and provides gap 118 which isolates cap 14 from duct assembly 100. The elimination of the impingement of hot discharge gases significantly reduces the temperature of cap 14 during compressor operation. Finally, the redirecting of the discharge gas away from cap 14 has been found to reduce the high frequency noise resulting from excitation of cap 14 by the discharge gas pulse impingement. This provides a quieter running compressor over most operating conditions.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a shell;

a first scroll member disposed in said shell and having a first spiral wrap;

a second scroll member disposed in said shell and having a second spiral wrap, said spiral wraps being mutually intermeshed;

means for causing said scroll members to orbit with respect to one another, whereby said wraps create at least one enclosed space of progressively changing volume between a suction port defined by said scroll members and a discharge port defined by one of said first and second scroll members;

a partition defining a discharge chamber and a suction chamber within said shell, said discharge port being in communication with said discharge chamber, said shell defining a fluid port in communication with said discharge chamber; and a duct disposed within said discharge chamber, said duct having an inlet aligned with said discharge port and an outlet aligned with said fluid port, said inlet and said outlet being generally perpendicular to one another.

2. The scroll machine according to claim 1 wherein, said duct is secured to said partition.

3. The scroll machine according to claim 2 wherein, a gap is defined between said partition and said inlet.

4. The scroll machine according to claim 1 further comprising a ramp disposed within said duct between said inlet and said outlet, said ramp smoothing the flow of fluid through said duct.

5. The scroll machine according to claim 1 wherein, said shell includes a top wall, said duct being located within said discharge chamber such that a gap is defined between said duct and said top wall.

6. The scroll machine according to claim 1 wherein, a gap is defined between said outlet and said fluid port.

7. The scroll machine according to claim 1 wherein, a gap is defined between said partition and said inlet.

8. The scroll machine according to claim 1 wherein, said duct includes an inner surface shaped to receive fluid from said inlet and direct said fluid to said outlet.

9. The scroll machine according to claim 8 further comprising a ramp disposed within said duct between said inlet and said outlet, said ramp smoothing the flow of fluid through said duct.

10. A scroll machine comprising:

a shell having an end wall and a side wall;

a partition disposed within said shell, said partition defining a discharge chamber and a suction chamber within said shell;

a fluid port extending through said side wall of said shell;

a first scroll member disposed in said suction chamber and having a first spiral wrap;

a second scroll member disposed in said suction chamber and having a second spiral wrap, said spiral wraps being mutually intermeshed;

means for causing said scroll members to orbit with respect to one another, whereby said wraps create at least one enclosed space for progressively changing volume between a suction port defined by said scroll members and a discharge port defined by one of said first and second scroll members, said discharge port directing compressed fluid towards said end wall;

a duct disposed within said discharge chamber, said duct having an inlet aligned with said discharge port and an outlet aligned with said fluid port, said inlet and said outlet being generally perpendicular to one another, said duct directing said compressed fluid towards to said fluid port.

11. The scroll machine according to claim 10 wherein, said duct is secured to said partition.

12. The scroll machine according to claim 11 wherein, a gap is defined between said partition and said inlet.

13. The scroll machine according to claim 10 further comprising a ramp disposed within said duct between said inlet and said outlet, said ramp smoothing the flow of fluid through said duct.

14. The scroll compressor according to claim 10 wherein, a gap is defined between said duct and said end wall.

15. The scroll machine according to claim 10 wherein, a gap is defined between said outlet and said fluid port.

16. The scroll machine according to claim 10 wherein, a gap is defined between said partition and said inlet.

17. The scroll machine according to claim 10 wherein, said duct includes an inner surface shaped to receive fluid from said inlet and direct said fluid to said outlet.

18. The scroll machine according to claim 17 further comprising a ramp disposed within said duct between said inlet and said outlet, said ramp smoothing the flow of fluid through said duct.

19. A scroll machine comprising:

a shell;

a first scroll member disposed in said shell and having a first spiral wrap;

a second scroll member disposed in said shell and having a second spiral wrap, said spiral wraps being mutually intermeshed;

means for causing said scroll members to orbit with respect to one another, whereby said wraps create at least one enclosed space of progressively changing volume between a suction port defined by said scroll members and a discharge port defined by one of said first and second scroll members;

a partition defining a discharge chamber and a suction chamber within said shell, said discharge port being in communication with said discharge chamber, said shell defining a fluid port in communication with said discharge chamber;

a duct disposed within said discharge chamber, said duct having an inlet aligned with said discharge port and an outlet aligned with said fluid port; and a ramp disposed within said duct between said inlet and said outlet, said ramp smoothing the flow of fluid through said duct.

20. A scroll machine comprising:

a shell having an end wall and a side wall;

a partition disposed within said shell, said partition defining a discharge chamber and a suction chamber within said shell;

a fluid port extending through said side wall of said shell;

a first scroll member disposed in said suction chamber and having a first spiral wrap;

a second scroll member disposed in said suction chamber and having a second spiral wrap, said spiral wraps being mutually intermeshed;

means for causing said scroll members to orbit with respect to one another, whereby said wraps create at least one enclosed space for progressively changing volume between a suction port defined by said scroll members and a discharge port defined by one of said first and second scroll members, said discharge port directing compressed fluid towards said end wall;

a duct disposed within said discharge chamber, said duct having an inlet aligned with said discharge port and an outlet aligned with said fluid port; and a ramp disposed within said duct between said inlet and said outlet, said ramp smoothing the flow of fluid through said duct.

* * * * *